US009375775B2

(12) United States Patent
Golovashchenko

(10) Patent No.: US 9,375,775 B2
(45) Date of Patent: Jun. 28, 2016

(54) HYDROMECHANICAL DRAWING PROCESS AND MACHINE

(71) Applicant: Ford Global Technologies, LLC, Dearborn, MI (US)

(72) Inventor: Sergey Fedorovich Golovashchenko, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 341 days.

(21) Appl. No.: 14/013,473

(22) Filed: Aug. 29, 2013

(65) Prior Publication Data

US 2014/0026630 A1 Jan. 30, 2014

Related U.S. Application Data

(62) Division of application No. 12/581,296, filed on Oct. 19, 2009, now Pat. No. 8,534,106.

(51) Int. Cl.

| | |
|---|---|
| ***B21D 26/02*** | (2011.01) |
| ***B21D 22/20*** | (2006.01) |
| ***B21D 26/12*** | (2006.01) |

(52) U.S. Cl.

CPC ..... *B21D 26/02* (2013.01); *B21D 22/205* (2013.01); *B21D 26/12* (2013.01); *Y10T 29/49805* (2015.01)

(58) Field of Classification Search

CPC ..... B21D 22/20; B21D 22/205; B21D 22/22; B21D 24/02; B21D 26/02; B21D 26/12; B21D 26/06; B21D 26/08; Y10T 29/49805

See application file for complete search history.

(56) References Cited

U.S. PATENT DOCUMENTS

| | | | | |
|---|---|---|---|---|
| 3,222,902 | A * | 12/1965 | Brejcha | B21D 26/12 29/421.2 |
| 3,232,086 | A | 2/1966 | Inoue | |
| 3,286,496 | A | 11/1966 | Burk | |
| 3,486,062 | A | 12/1969 | Schrom | |

(Continued)

FOREIGN PATENT DOCUMENTS

| | | | | |
|---|---|---|---|---|
| DE | 2853271 A1 * | 6/1979 | | B21D 26/02 |
| DE | 33059092 | 9/1983 | | |

(Continued)

OTHER PUBLICATIONS

J.E. Sandford, "High Velocity Takes Off Again" Iron Age, Mar. 6, 1969—pp. 91-95.

(Continued)

*Primary Examiner* — Edward Tolan

(74) *Attorney, Agent, or Firm* — Damian Porcari; Brooks Kushman P.C.

(57) ABSTRACT

A hydromechanical forming tool is disclosed that may include electro-hydraulic forming chambers in which a stored charge circuit may be discharged through electrodes to improve the level of detail that may be formed in a blank. The hydromechanical forming tool may include a liquid chamber at the entrance to the draw chamber to reduce friction, as the blank is drawn into the draw chamber. The draw chamber may have a movable bottom wall that is moved in tandem with the punch to reduce the amount of liquid in the draw chamber and reduce the need to pump liquid into and out of the draw chamber during a hydromechanical forming tool cycle.

3 Claims, 9 Drawing Sheets

(56) References Cited

U.S. PATENT DOCUMENTS

| | | | |
|---|---|---|---|
| 3,559,434 | A | 2/1971 | Keinanen |
| 3,559,435 | A | 2/1971 | Gerber |
| 3,566,648 | A | 3/1971 | Norin et al. |
| 3,575,631 | A | 4/1971 | Pratt |
| 3,603,127 | A | 9/1971 | Seiffert et al. |
| 3,631,700 | A | 1/1972 | Kosaka |
| 3,750,441 | A | 8/1973 | Schneider et al. |
| 3,769,824 | A | 11/1973 | Granzow |
| 4,030,329 | A | 6/1977 | Chachin et al. |
| 4,229,965 | A | 10/1980 | Spacek et al. |
| 4,314,468 | A | 2/1982 | Baril et al. |
| 4,361,020 | A | 11/1982 | Hirota et al. |
| 4,472,955 | A | 9/1984 | Nakamura et al. |
| 5,271,142 | A | 12/1993 | Moore, III et al. |
| 6,085,562 | A | 7/2000 | Daehn et al. |
| 6,128,935 | A | 10/2000 | Daehn et al. |
| 6,227,023 | B1 | 5/2001 | Daehn et al. |
| 6,675,621 | B2 | 1/2004 | Kleber |
| 6,708,542 | B1 | 3/2004 | Gafri et al. |
| 6,708,543 | B2 | 3/2004 | Yoshioka et al. |
| 6,938,449 | B2 | 9/2005 | Kusunoki et al. |
| 7,007,531 | B2 | 3/2006 | Donhauser et al. |
| 7,802,458 | B2 | 9/2010 | Moeller et al. |
| 2006/0185413 | A1 | 8/2006 | Nobata |
| 2008/0134741 | A1 | 6/2008 | Golovashchenko et al. |

FOREIGN PATENT DOCUMENTS

| | | | | |
|---|---|---|---|---|
| DE | 10027079 | A1 * | 12/2001 | ..... B21D 22/22 |
| DE | 10208532 | C1 * | 6/2003 | ..... B21D 22/205 |
| DE | 10248329 | A1 * | 4/2004 | ..... B21D 22/205 |
| DE | 10313072 | A1 * | 9/2004 | ..... B21D 22/205 |
| EP | 0549955 | | 7/1993 | |
| GB | 1068440 | | 5/1967 | |
| GB | 1095276 | | 12/1967 | |
| GB | 1241343 | | 8/1971 | |
| GB | 1262072 | | 2/1972 | |
| GB | 1294240 | | 10/1972 | |

OTHER PUBLICATIONS

David Van Cleave et al., High-Energy Forming Techniques Improve Parts at Reduced Costs, Product Engineering, Dec. 21, 1970, pp. 25-26.

J.E. Sandford, Recent Advances Stir Interest in High Velocity Forming, Iron Age Metalworking International, Oct. 1970, pp. 36-38.

* cited by examiner

HYDROMECHANICAL DRAWING PROCESS AND MACHINE

CROSS-REFERENCE TO RELATED APPLICATION

This application is a division of U.S. application Ser. No. 12/581,296 filed Oct. 19, 2009, the disclosure of which is hereby incorporated in its entirety by reference herein.

BACKGROUND

1. Technical Field

The present invention relates to improvements to hydromechanical drawing machines and techniques for forming sheet metal blanks.

2. Background Art

Hydromechanical drawing is a process of forming sheet metal by clamping the edges of a sheet metal blank and drawing the central portion of the blank with a punch. The area below the blank is filled with a liquid, such as water. The liquid forms the blank against the punch surface. Liquid below the clamped edge of the blank lifts a portion of the blank where the blank enters the die cavity. The liquid below the blank at the flange reduces friction as the blank enters the die cavity.

One of the principal advantages of hydromechanical forming is that a second die surface may be eliminated in some applications with the liquid providing the reaction surface for the punch. In production parts, the required pressure is dictated by the tightest local radius to be formed. Maximum pressure must be applied to the entire surface of the blank. As a result, large presses must be used to perform the forming operation.

To improve the sharpness or part shape definition achieved in a hydromechanical forming operation, a second die may be incorporated in a hydromechanical forming tool. The second or lower die is only contacted after the drawing operation is nearly complete. Forming areas having a tight radius and other local features is completed by the punch driving the blank into engagement with the second die. The hydromechanical drawing process enables deep drawing of blanks provided that the maximum elongation of the blank is within the conventional forming limit diagram of the material being formed. Press size may be reduced by providing a second die because fine details may be formed when the punch engages the lower die.

One disadvantage with this approach includes the cost of providing a second die. Another disadvantage is that the punch and lower die must be precisely aligned to minimize die marks and surface imperfections. A further disadvantage is that the frictional force applied to the blank from both sides of the tool results in less uniform strain distribution. Another disadvantage of this process is that high volumes of liquid must be pumped into and out of the lower die cavity with each stroke of the press. Pumping large volumes of liquid in and out of the die takes a substantial amount of time and energy.

While it is not essential that the blank is supported on the liquid surface throughout the entire punch drawing operation, one of the principal advantages of hydromechanical forming is that liquid may be used to reduce friction at the upper perimeter of the lower die where the blank is drawn into the lower die.

Increasingly, new forming techniques are being developed for forming advanced high strength steel (AHSS), ultra high strength steels (UHSS) and specialized aluminum alloys that are difficult to form. One process that has been suggested to improve formability of such material is electro-hydraulic forming. However, deep drawing with electro-hydraulic forming is difficult due to the fact that the pressure exerted on the blank is very substantially reduced as the distance between the electrodes and forming surface increases. Similarly, as the volume of the electro-hydraulic forming chamber increases, the pressure available for forming the blank decreases. In forming shallow parts from such advanced materials, the distance from the electrode does not create a major issue. The reduction of pressure, as the blank is moved away from the electrode, reduces the ability of the system to deep draw a blank.

Applicant's invention is directed to solving the above problems and other problems as summarized below.

SUMMARY

According to one aspect of the disclosed hydromechanical forming machine, a lower tool of the machine is provided with a movable bottom wall that moves within a lower ring. Liquid is contained within the lower ring on the bottom wall. The blank is formed by a punch of the upper tool against the liquid in the lower tool. The bottom wall moves in tandem with the punch, so that the volume of liquid in the lower tool may remain relatively constant without the need to repeatedly fill and drain the draw cavity defined by the lower tool.

To reduce friction, a second liquid cavity may be provided as described above in the area around the entrance to the lower cavity.

The above concepts may be applied to forming various parts that may be categorized as deep drawn parts and shallow drawn parts. Further, either deep drawn parts or shallow drawn parts may have deep local features or shallow local features. Applicant's development is particularly well suited to forming deep drawn parts having deep local features in a system that requires only a small volume of liquid to be pumped into and out of the cavity in the lower die. However, the system may also be used to form deep drawn parts having deep local features in a system that requires a large volume of liquid to be pumped into and out of the cavity in the lower die. The improvements disclosed may also be used to form deep drawn parts having shallow local features with a small volume of liquid being pumped into and out of the cavity in the lower die.

Another improvement in this instance is achieved by providing a ring of liquid at the entrance to the cavity in the lower die. Applicant's development can also be used to improve applications where a shallow drawn part is provided with deep local features and in which a small volume of liquid is pumped into and out of the lower die cavity.

These and other advantages and features of the improved hydromechanical forming tool may be understood in view of the attached drawings and the following detailed description of the illustrated embodiments.

DETAILED DESCRIPTION

Figure 1:
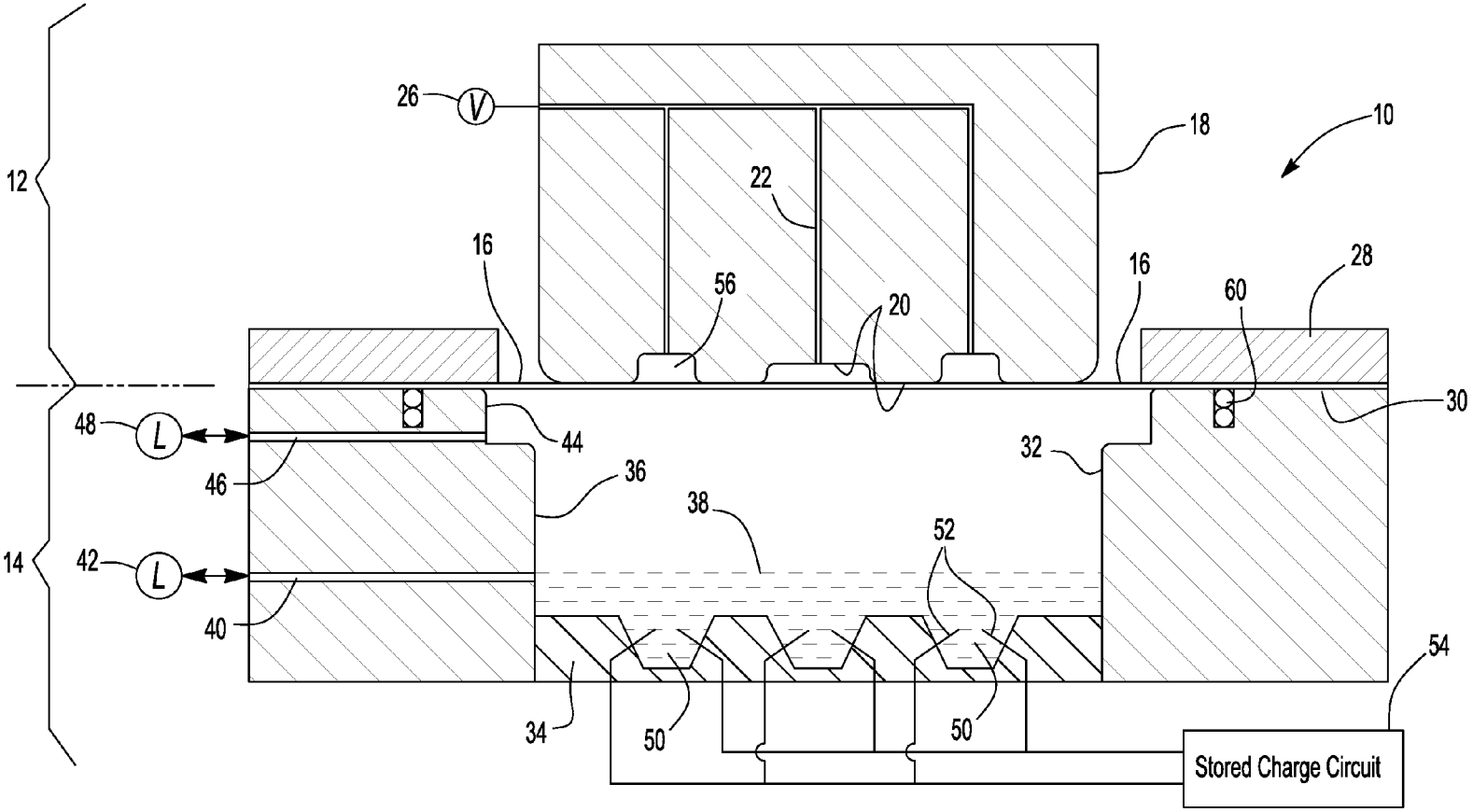
FIG. 1 is a diagrammatic cross-sectional view of one embodiment of the improved hydromechanical forming tool shown with the punch engaging the blank prior to beginning the drawing operation.
Figure 2:
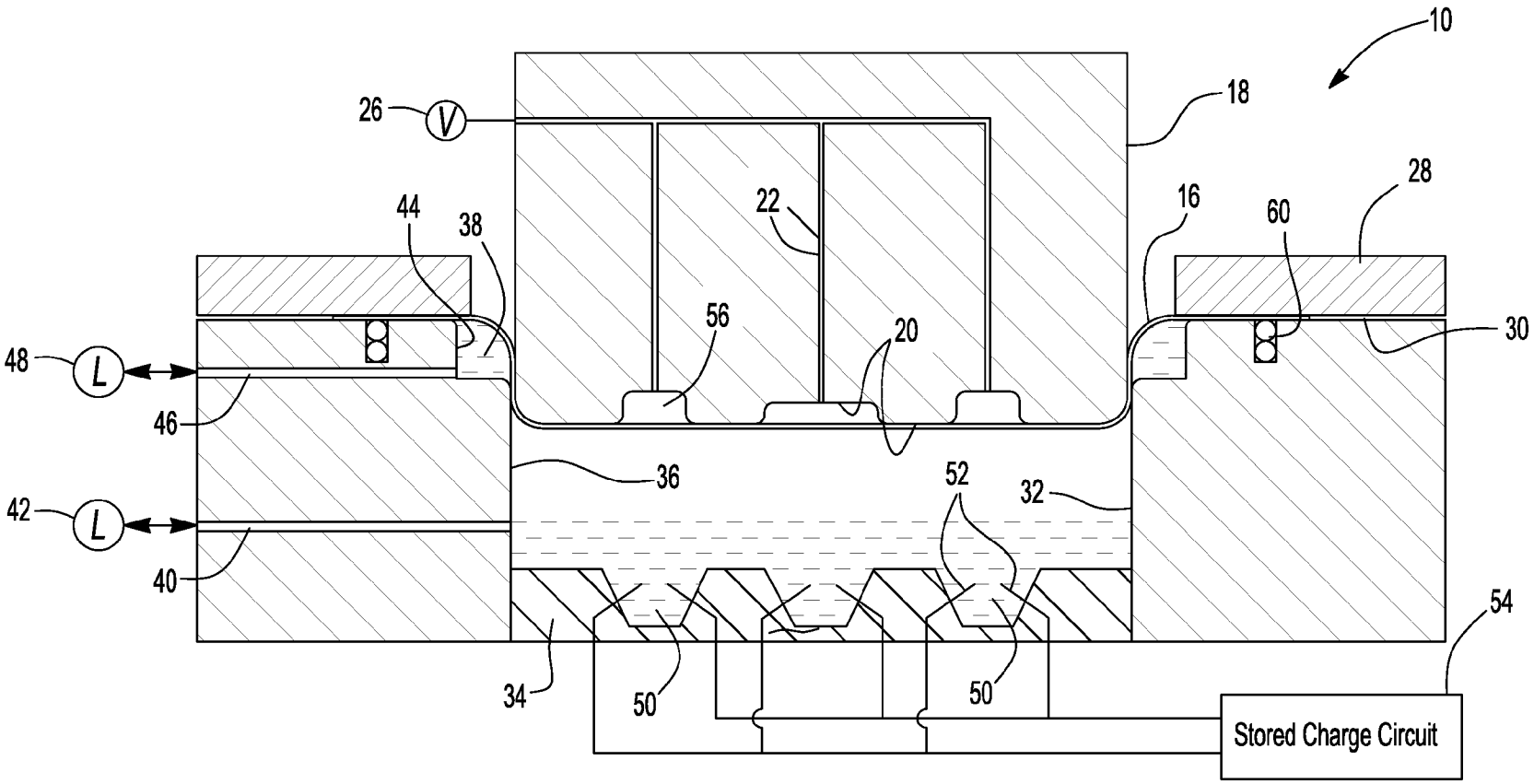
FIG. 2 is a diagrammatic cross-sectional view similar to FIG. 1 showing the hydromechanical forming machine at an intermediate point in the hydromechanical drawing operation.
Figure 3:
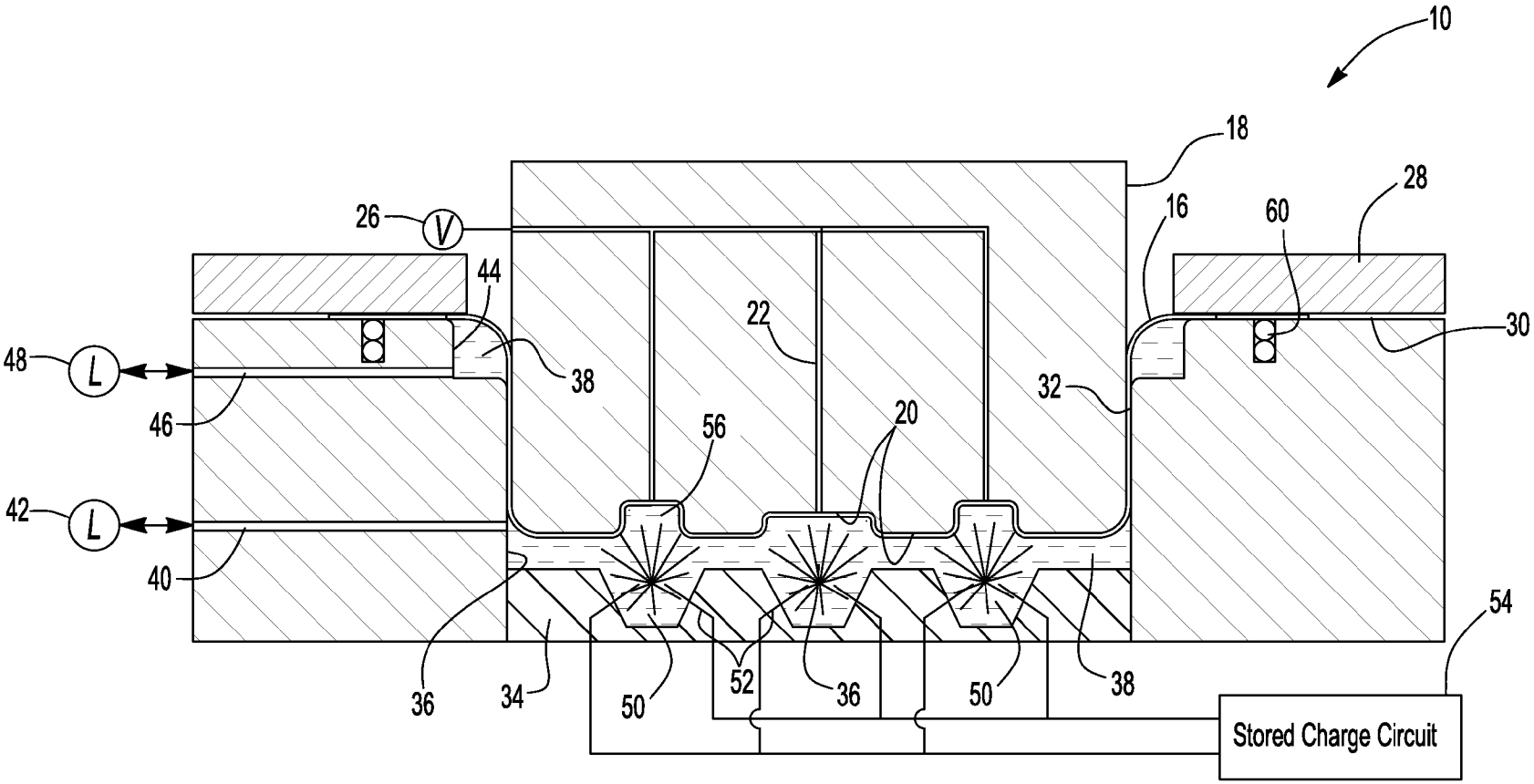
FIG. 3 is a diagrammatic cross-sectional view similar to FIG. 1 showing the tool in the fully drawn position after the completion of the electro-hydraulic forming step.

Referring to FIGS. 1-3, a hydromechanical forming tool 10 is illustrated that includes an upper die 12 and a lower die 14. The upper and lower dies are set into a hydromechanical forming machine to form a blank 16, as is well known in the art.

The upper die 12 includes a punch 18 that defines a forming surface 20. The forming surface 20 is driven into the blank 16 to draw the blank into a desired shape. Vacuum channels 22 are provided in the punch 18 that are in fluid flow communication with a source of vacuum 26.

A clamping ring 28 is also part of the upper die 12. The clamping ring 28 engages the blank 16 and holds it against a support surface 30 provided by the lower die 14. The support surface 30 engages the blank 16 in a peripheral area that may be referred to as the draw flange. The draw flange is held between the clamping ring 28 and support surface 30, as the blank 16 is drawn to shape.

The lower die 14 is formed by a side wall 32 and a base wall 34 that together define a draw chamber 36. Liquid, such as water or an aqueous solution including a rust preventative or a lubricant, is contained within the draw chamber 36. The draw chamber 36 may be provided with liquid 38 through one or more fill/drain channels 40 that are formed in the lower die 14. The liquid may be replenished through the fill/drain channel 40. The fill/drain channel 40 is in fluid flow communication with a liquid source 42 that may be a tank or other reservoir.

A chamber 44 is provided at the entrance to the draw chamber 36. The liquid in the chamber 44 reduces friction at the entrance to the draw chamber 36. Liquid may be provided to the chamber 44 through a fill/drain channel 46 that is in fluid flow communication with the liquid source 48.

In the embodiment illustrated in FIGS. 1-3, the draw chamber is only partially filled with liquid. A volume of air is initially provided in the draw chamber 36 that is exhausted from the chamber 36 as the punch 18 forms the blank 16, until the blank 16 is formed into contact with the liquid in the chamber 36. The liquid in the draw chamber 36 is only engaged near the end of the draw stroke. The liquid functions as the medium for electro-hydraulic forming.

A plurality of electro-hydraulic forming (EHF) chambers 50 are provided in the base wall 34. The EHF chambers 50 each include a pair of electrodes 52 of which at least one electrode is insulated from the chamber. The electrodes are connected to a stored charge circuit 54. The EHF forming chambers 50 are used to form details 56, such as deep local features, on the forming surface 20 of the punch 18.

A draw flange seal 60 is provided on the lower side of the blank 16 to seal the liquid within the chamber 44.

The draw flange seal 60 may be metal seals that are backed by elastomeric backing members to provide a durable seal against which the blank may be drawn without damaging the seal. The structure of the seals is disclosed in Applicant's prior co-pending application, Ser. No. 12/563,487, filed Sep. 21, 2009, the disclosure of which is hereby incorporated by reference.

Referring specifically to FIG. 1, the hydromechanical forming tool 10 is shown with the punch 18 contacting the blank 16, and the blank 16 being held in place by the clamping ring 28 on the support surface 30. The liquid 38 in the draw chamber 36 only partially fills the draw chamber 36 and no liquid is provided in the chamber 44. The level of liquid in the draw chamber 36 may be regulated by the fill/drain channel 40 at the desired level in the draw chamber 36.

Referring to FIG. 2, the punch 18 is shown as it draws the blank 16 into the draw chamber 36. As the blank is drawn into the draw chamber 36, it engages the side walls 32 forming a seal with the side wall. The chamber 44 is filled through the fill/drain channel 46 from the liquid source 48. The liquid in the chamber 44 reduces friction as the blank 16 is drawn into the draw chamber 32. Alternatively, the chamber 44 could be filled with compressed air that could also provide a low friction media to reduce friction as the blank is drawn into the draw chamber.

Referring to FIG. 3, the punch 18 is shown inserted to the maximum extent into the draw chamber 36. At this point, the blank 16 is driven into engagement with the liquid contained in the draw chamber 36 to partially form the blank into the recessed areas or detailed areas 56 formed on the forming surface 20 of the punch 18. At this point, vacuum has been drawn through the vacuum channels 22 by the source of vacuum 26 which facilitates the liquid forming the blank against the die surface.

As a further step, the electro-hydraulic forming step may begin by discharging the stored charge circuit 54 through the electrodes 52 that are disposed within the EHF chambers 50. The arc discharge between the electrodes 52 creates a shock-wave in the liquid that drives the liquid into the deep local features 56 formed on the forming surface 20 of the punch 18. The discharge may be simultaneous or preferably would be a sequential discharge in which the stored charge circuit 54 is discharged through each of the sets of electrodes 52 at different time intervals. By providing sequential discharges, it may be possible to reduce the press tonnage required to balance the EHF pressure.

In the embodiment of FIGS. 1-3, a part may be deep drawn with deep local features 56. Only a small volume of liquid is pumped into and out of the draw chamber 36.

In all of the other figures, the same reference numerals are used to refer to corresponding parts described with reference to FIGS. 1-3.

Figure 4:
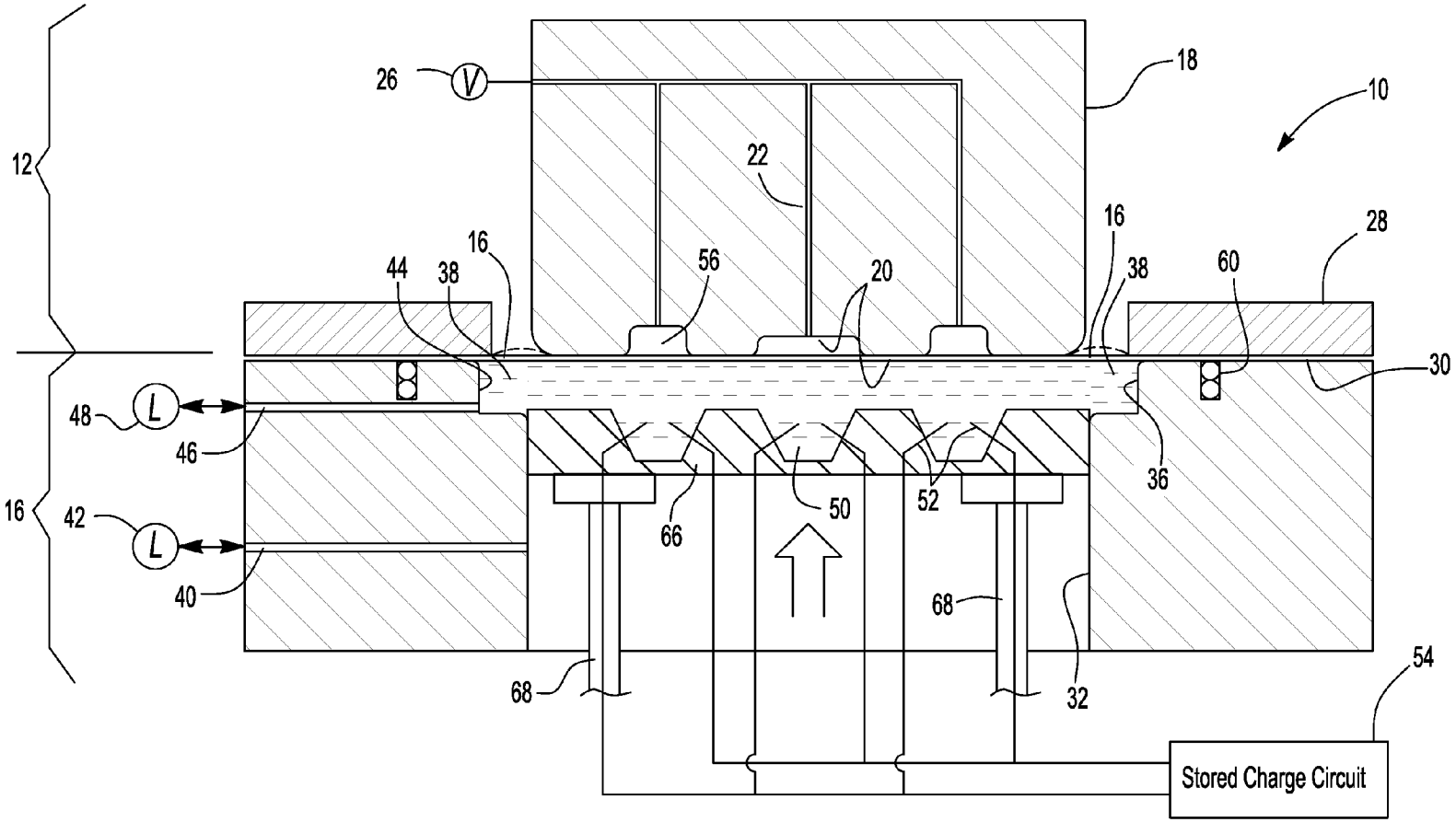
FIG. 4 is a diagrammatic cross-sectional view of an alternative embodiment shown with the floor of the lower tool shifted upwardly and the punch just beginning to engage the blank.
Figure 5:
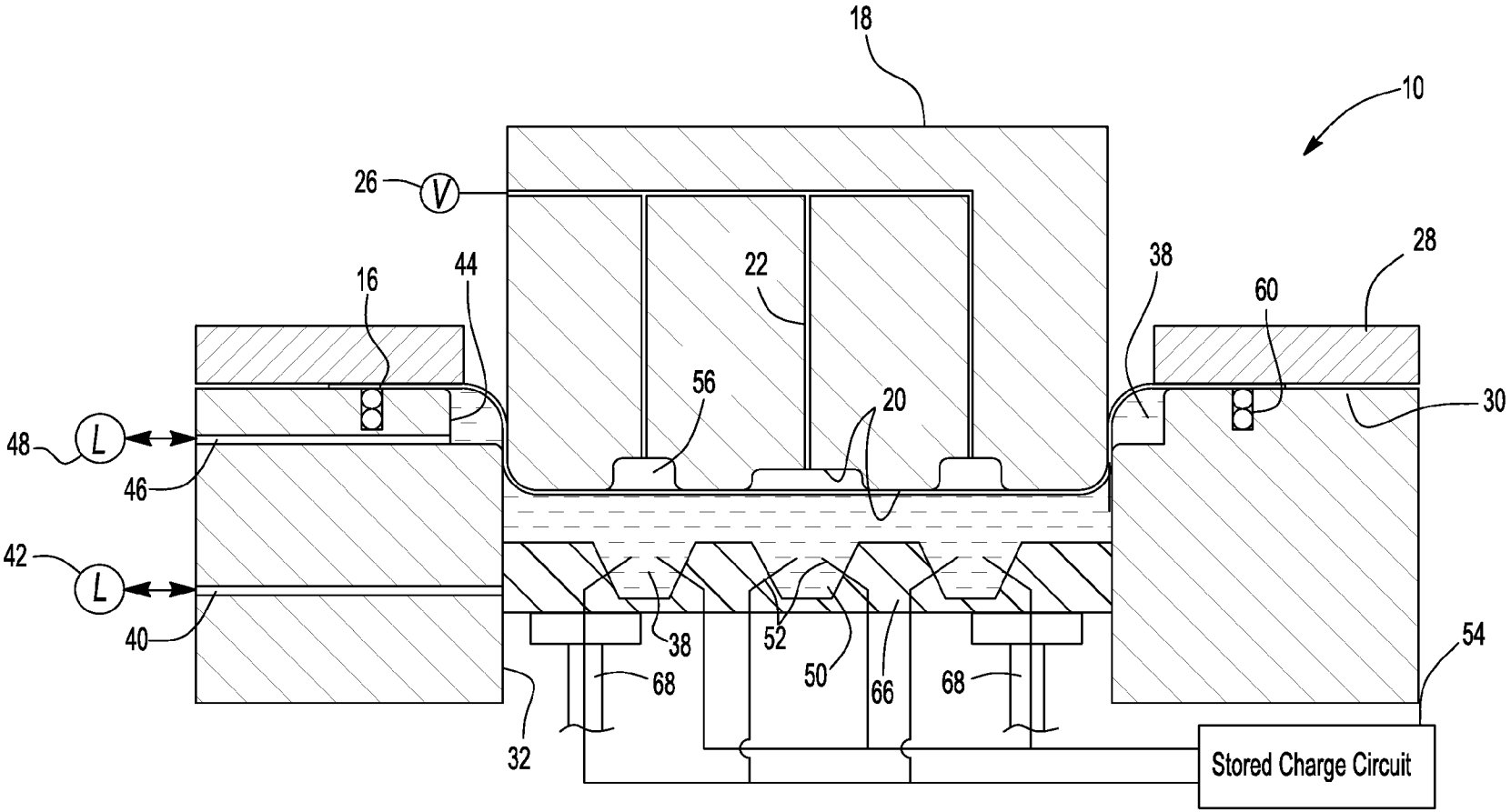
FIG. 5 is a view similar to FIG. 4 at an intermediate point in the hydromechanical drawing operation.
Figure 6:
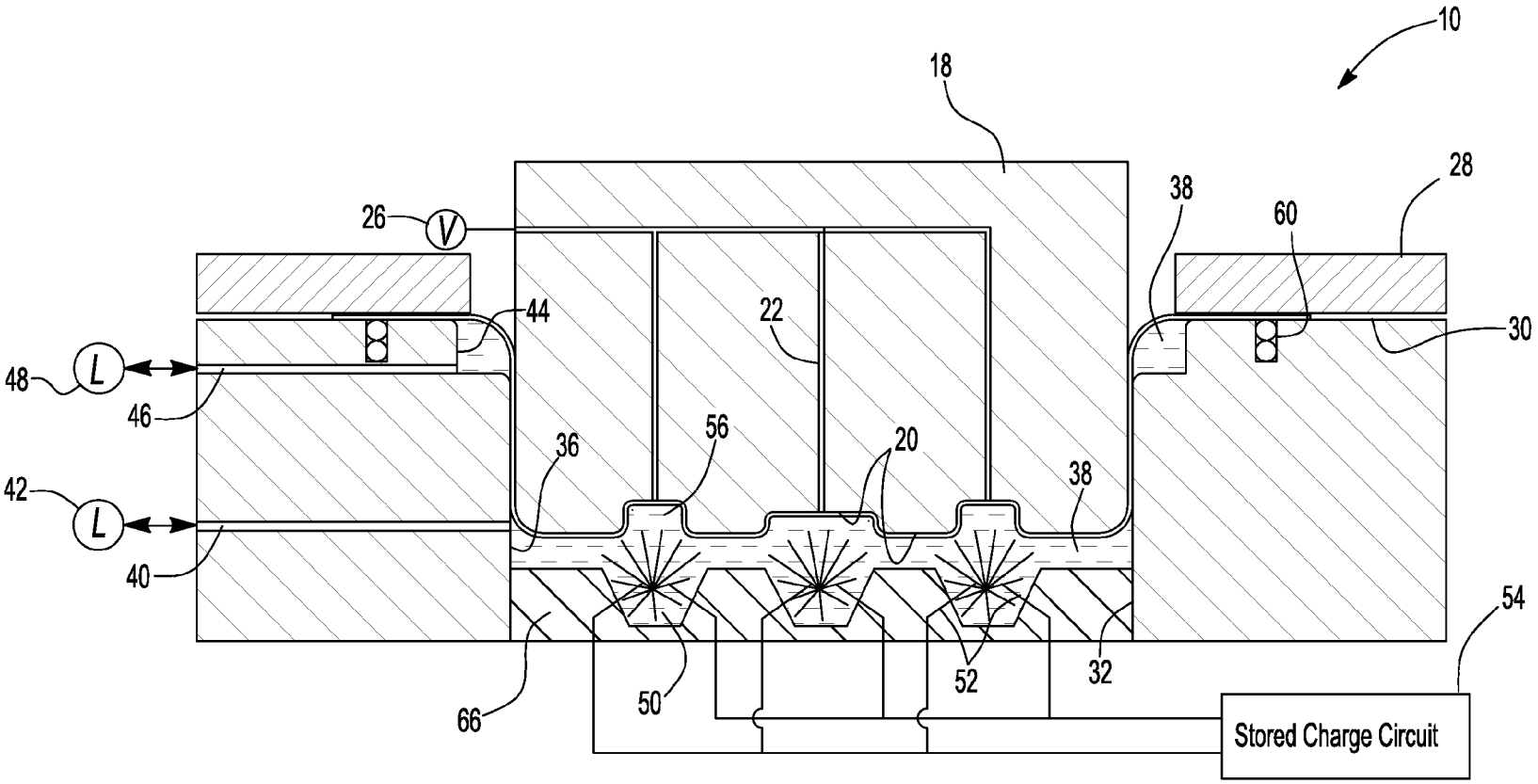
FIG. 6 is a view similar to FIG. 4 showing the punch in the fully drawn position with the electro-hydraulic forming system being discharged to form the blank against the surface of the punch.

Referring to FIGS. 4-6, an alternative embodiment of the hydromechanical forming tool 10 is illustrated. Additional elements disclosed in FIGS. 4-6 include a movable bottom wall 66 that includes EHF chambers 50. The movable wall 66 is moved by an actuator 68, such as the hydraulic cylinder or other press drive actuator. The movable bottom wall 66 supports a volume of liquid 38 within the draw chamber 36. The actuator 68 moves the bottom wall 66 to provide a quantity of liquid in the draw chamber 36 with the upper surface of the liquid engaging the lower surface of the blank 16.

Referring to FIG. 4, the tool 10 is shown with the punch 18 engaging the blank 16 while the blank is held between the clamping ring 28 and the support surface 30. The movable bottom wall 66 is elevated within the draw chamber 36, and the volume of liquid 38 is maintained generally in contact with the bottom surface of the blank 16.

Referring to FIG. 5, the tool 10 is shown with the forming surface 20 of the punch 18 engaging the blank 16. The movable floor of bottom wall 66 is partially retracted into the draw chamber 36. The bottom wall 66 preferably moves in tandem with the punch 18 and may be coordinated by limit switches, sensors or pressure transducers. The liquid 38 exerts a force on the bottom of the blank 16 that forces the blank into engagement with the forming surface 20. The liquid 38 is supplied to the chamber 44 from the draw chamber 36. The liquid in the chamber 44 reduces friction at the top of the draw chamber 36 where the blank is drawn into the draw chamber 36. Seals 60 contain the liquid within the chamber 44.

Referring to FIG. 6, the punch 18 is shown fully extended into the draw chamber 36. A vacuum is drawn through the vacuum channels 22 by the source of vacuum 26 to remove air from the area between the forming surface 20 and the blank 16. The EHF forming process is then initiated by discharging the stored charge circuit 54 through the electrodes 52. When the EHF discharge occurs, a shockwave is transmitted through the liquid 38 that drives the blank into the details 56, or deep local features, that are formed on the forming surface 20.

It should be appreciated that by providing the movable bottom wall 66 it is not necessary to pump large volumes of liquid into and out of the draw chamber 36, as the punch is extended and retracted. In the embodiment of FIGS. 4-6, deep drawn parts having deep local features may be formed. The liquid 38 is provided to initially form the blank into engagement with the forming surface 20. The liquid 38 is also available for use as the medium in the electro-hydraulic forming operation. The liquid 38 may be filled or drained from the chamber through the fill/drain channel 40 that is in liquid flow communication with liquid source 42.

Figure 7:
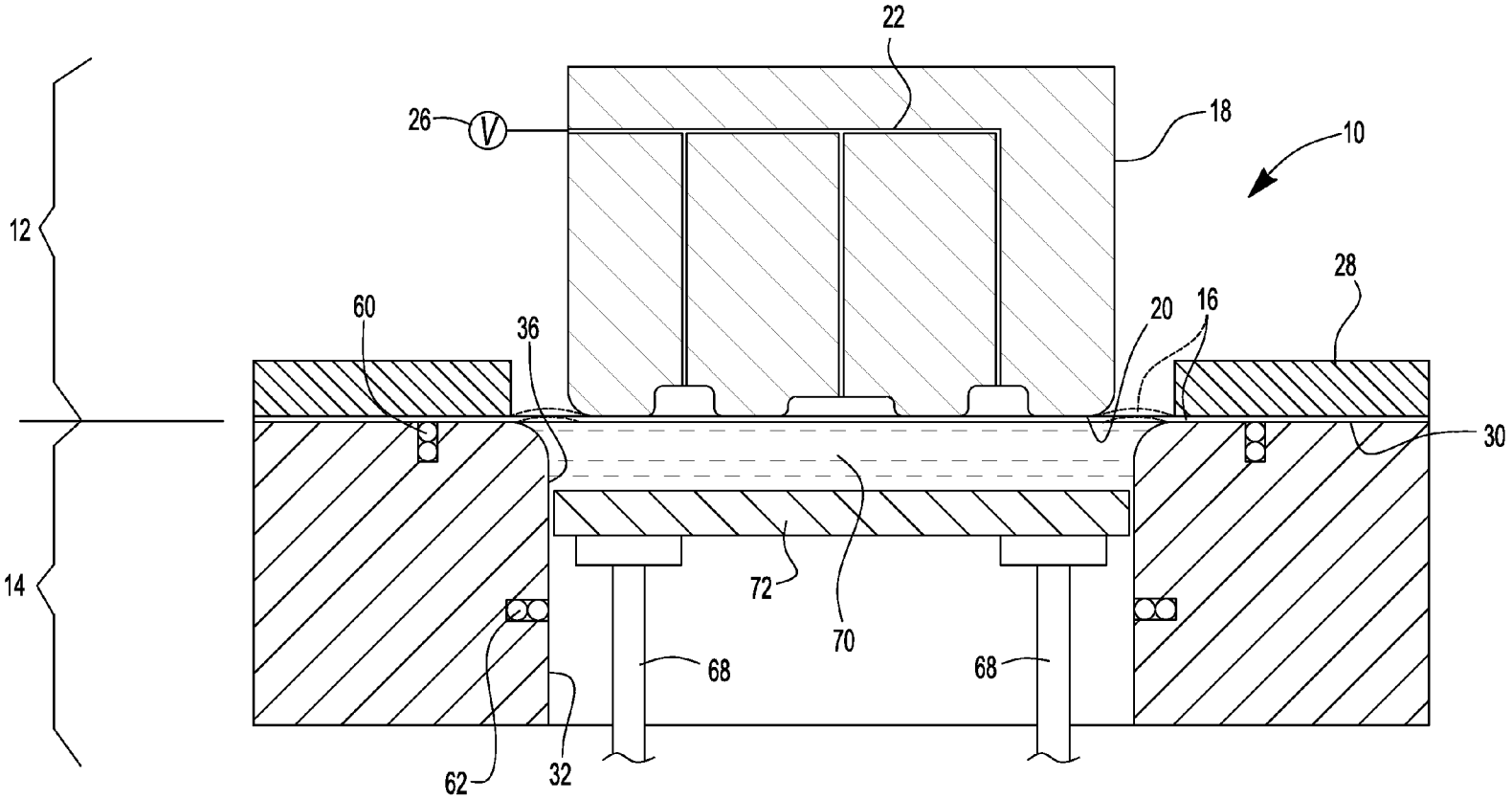
FIG. 7 is a diagrammatic cross-sectional view of another embodiment of a hydromechanical forming tool with a lower tool including a movable bottom wall with the draw punch engaging the blank just prior to beginning the drawing operation.
Figure 8:
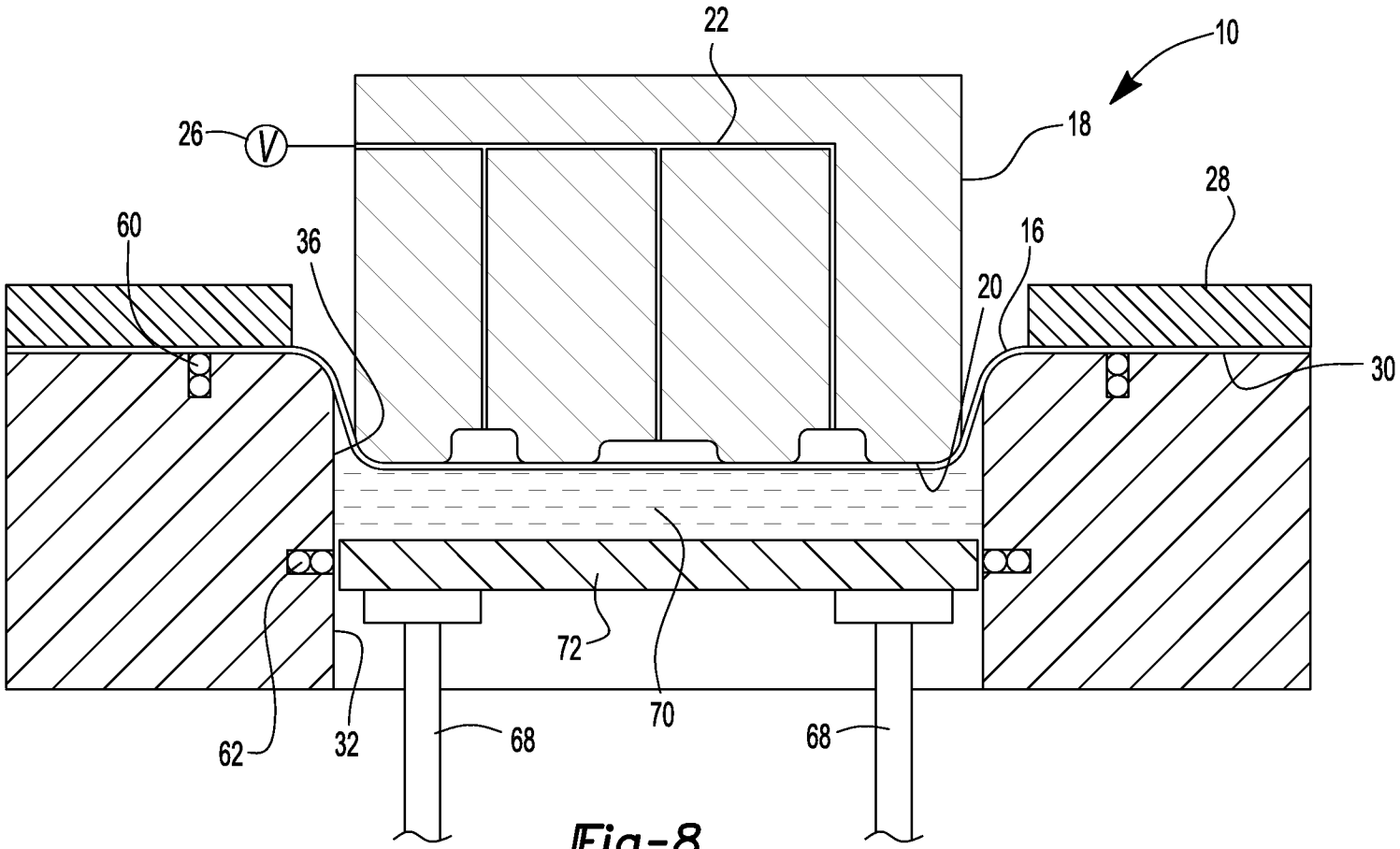
FIG. 8 is a diagrammatic cross-sectional view similar to FIG. 7 showing the draw punch drawing the panel into the drawing chamber with the bottom wall of the lower tool moving in tandem with the punch movement as the blank is drawn into the lower tool.

Referring to FIGS. 7 and 8, another alternative embodiment is shown of the hydromechanical forming tool 10. In the embodiment of FIGS. 7 and 8, a movable bottom wall 72 is provided as a floor to the draw chamber 36 that does not have electro-hydraulic forming chambers. The movable bottom wall 72 may be used with a conventional hydromechanical forming tool 10 that does not entail the use of an electro-hydraulic forming operation. In this embodiment, deep drawn parts may be formed with relatively shallow local features.

As shown in FIG. 7, the movable bottom wall 72 is shown at its extended or uppermost position. A volume of liquid 38 is provided within the chamber above the movable bottom wall 72. The movable bottom wall 72 is moved by the actuator 68 as described with references to FIGS. 4-6 above. The punch 18 is shown engaging the blank 16 with a draw flange of the blank 16 being clamped between the clamping ring 28 and the support surface 30. Liquid 38 above the movable bottom wall 72 is provided from the draw chamber 36 below the blank 16 at the entrance to the draw chamber 36. Clearance between the punch 18 and the side wall 32 allows the blank 16 to bulge, as shown in phantom lines, in response to the force of the liquid 38 on the lower surface of the blank 16.

Referring to FIG. 8, the punch 18 is shown drawing the blank into the draw chamber 36. Vacuum may be pulled through the vacuum channels 22 to the source of vacuum 26 to reduce resistance to the blank being formed into the recesses of the forming surface 20. The hydraulic actuator 68 moves the movable bottom wall 72 downwardly as the punch 18 draws the blank 16 into the draw chamber 36. The liquid 38 in the draw chamber 36 forces the blank to conform to the forming surface 20. The volume of liquid may remain relatively constant. As a result, it is not necessary to pump large volumes of liquid out of the draw chamber 36 as the punch 18 is driven against the blank 16 and into the draw chamber 36. Liquid 38 in the bulge in the blank reduces friction as the blank 16 is drawn into the draw chamber 36. The seals 60 and 62 seal the liquid within the draw chamber 36. It should be understood that other seals may be provided on the movable bottom wall 72 or in other critical sealing areas within the hydromechanical forming tool 10.

Figure 9:
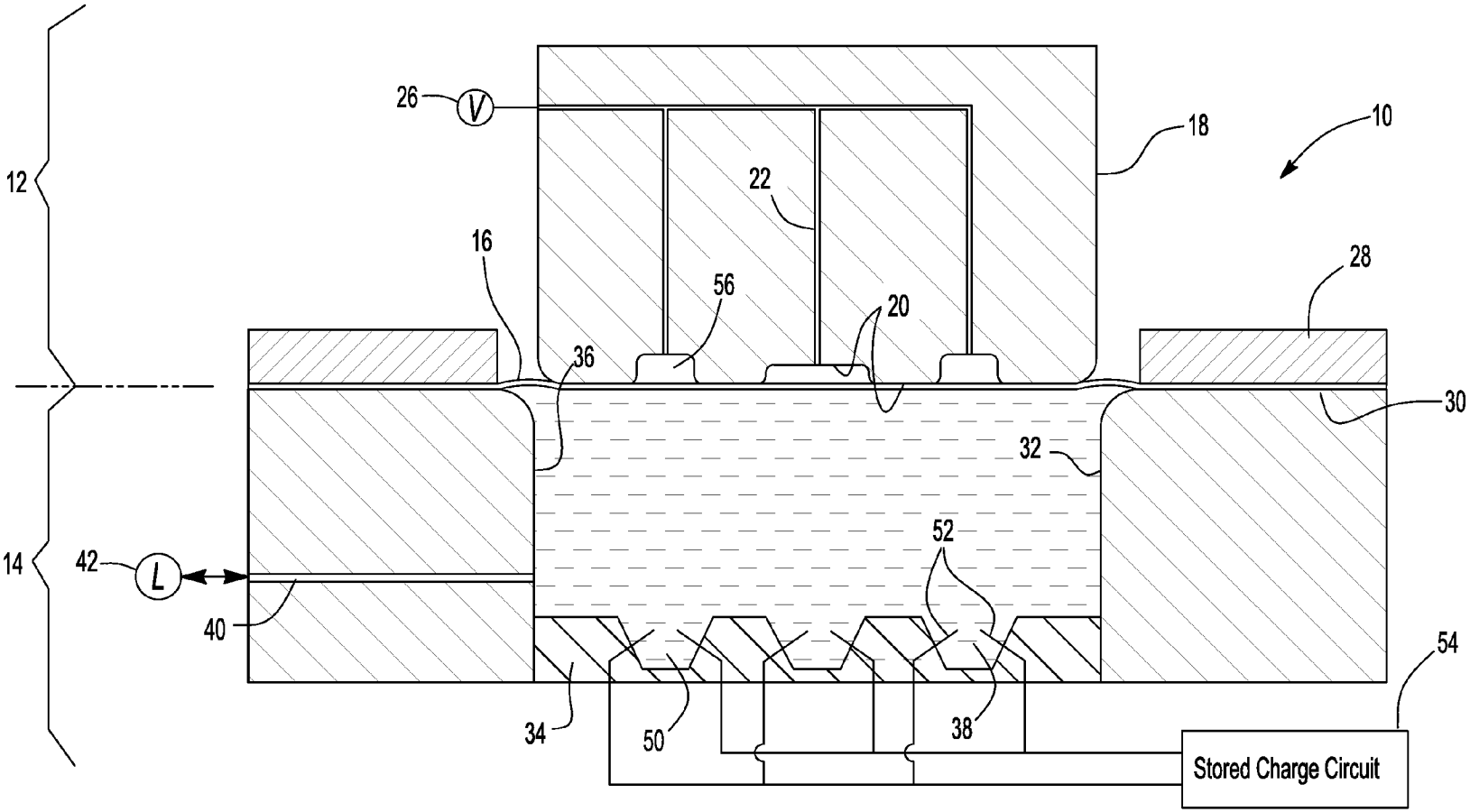
FIG. 9 is a diagrammatic cross-sectional view of an alternative embodiment in which a hydromechanical forming tool that is fully filled with liquid is provided with several electro-hydraulic forming chambers as the punch is just beginning to engage the blank.

Referring to FIG. 9, another embodiment of the hydromechanical forming tool 10 is shown that is substantially similar to the embodiment of FIGS. 1-3 with the principal differences between that the draw chamber 36 is completely filled with liquid 38. Also, there is no separate liquid chamber 44, as was provided in the embodiment of FIGS. 1-3. The embodiment of FIG. 9 may be used to form parts that are deep drawn and also have deep local features.

As shown in FIG. 9, the liquid 38 may create a bulge in the blank 16 between the punch 18 and the clamping ring 28 as a result of the pressure applied to the blank by the punch 18. In this embodiment, a relatively large volume of liquid must be pumped into and drained from the draw chamber 36 in the course of the forming cycle. Liquid is supplied to and drained from the draw chamber 36 through the channel 40 and to the source of liquid 42. The forming cycle described with reference to FIGS. 1-3 is repeated in the embodiment of FIG. 9 except that a larger volume of liquid is pumped into and out of the draw chamber 36, and there is no separate compartment 44 that provides liquid to reduce friction at the entrance to the draw chamber 36.

As the forming cycle continues after the initial contact shown in FIG. 9, the punch 18 draws the blank 16 into the draw chamber 36 with the liquid below the blank 16 causing the blank to bulge slightly between the clamping ring and the punch 18. The liquid reduces friction at the entrance to the draw chamber 36. Air is evacuated through the channels 22 to the source of vacuum 26. The storage charge circuit (not shown in FIG. 9 but analogous to that shown in FIG. 1) is discharged through the electrodes 52 that are provided in the electro-hydraulic forming chambers 50. The discharge creates an arc that transmits a shockwave to form the blank 16 into the deep draw local features 56.

In the embodiment shown in FIG. 9, the objectives of providing a deep drawn part with deep local features are achieved; however, the disadvantage of prior art hydromechanical forming tools remains in that a large volume of liquid must be pumped into and out of the draw chamber in the course of the forming cycle.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed:

1. A hydro-mechanical forming machine comprising:

an upper tool including a punch that has a die surface, and a blank holder receiving the punch with the punch being moved reciprocally relative to the blank holder;

a lower tool including a lower ring that has a blank receiving surface and that defines a first cavity into which a first volume of liquid is supplied, and a second cavity that may be separated from the first cavity defined by the lower ring inboard of the blank receiving surface and by the blank, as the blank is formed by the punch into the open die, wherein a second volume of fluid is supplied to the second cavity under pressure that supports the blank as the blank is formed into the open die;

a bottom wall that is movable within the lower ring, wherein the first volume of liquid is contained within the lower ring and on the bottom wall, wherein a blank is formed against the liquid by the punch, and wherein the bottom wall is lowered within the lower ring as the punch forms the blank; and an electro-hydraulic discharge system disposed in the liquid contained in an electro-hydraulic forming chamber that is discharged after the punch draws the blank into the lower ring, wherein actuation of the electro-hydraulic discharge system forms the blank against the punch.

2. A hydro-mechanical forming machine comprising:

an upper tool including a punch that has a die surface, and a blank holder receiving the punch with the punch being moved reciprocally relative to the blank holder;

a lower tool including a lower ring that has a blank receiving surface against which the blank holder clamps the blank as the blank is formed by the punch, a container defined by a bottom wall movable within the lower ring, and a liquid contained within the lower ring on the bottom wall, wherein a blank is formed against the liquid by the punch, and wherein the bottom wall is lowered within the lower ring as the punch forms the blank; and an electro-hydraulic forming chamber provided with in the container, and an electro-hydraulic discharge system that is actuated in the liquid contained in the electro-hydraulic forming chamber after the punch draws the blank into the lower ring, wherein actuation of the discharge system forms the blank against the punch.

3. The machine of claim 2 further comprising a second liquid cavity that may be separated from the first liquid cavity defined by the lower ring inboard of the blank receiving surface and by the blank, as the blank is formed by the punch into the open die, wherein a second volume of liquid is supplied to the second liquid cavity under pressure that supports the blank, as the blank is formed into the open die.

* * * * *